US010878727B2

(12) United States Patent
Shaw-Smith

(10) Patent No.: US 10,878,727 B2
(45) Date of Patent: Dec. 29, 2020

(54) DISPLAY SIGN

(71) Applicant: Mark Shaw-Smith, Chipping Norton (GB)

(72) Inventor: Mark Shaw-Smith, Chipping Norton (GB)

( * ) Notice: Subject to any disclaimer, the term of this patent is extended or adjusted under 35 U.S.C. 154(b) by 0 days.

(21) Appl. No.: 16/463,696

(22) PCT Filed: Nov. 21, 2017

(86) PCT No.: PCT/EP2017/079965

§ 371 (c)(1),
(2) Date: May 23, 2019

(87) PCT Pub. No.: WO2018/095927

PCT Pub. Date: May 31, 2018

(65) Prior Publication Data

US 2019/0287432 A1 Sep. 19, 2019

(30) Foreign Application Priority Data

Nov. 25, 2016 (GB) ..... 1619963.0

(51) Int. Cl.

| | |
|---|---|
| ***G09F 7/10*** | (2006.01) |
| ***G09F 7/20*** | (2006.01) |
| ***G09F 23/06*** | (2006.01) |
| ***G09F 7/08*** | (2006.01) |

(52) U.S. Cl.

CPC ..... *G09F 7/10* (2013.01); *G09F 7/08* (2013.01); *G09F 7/20* (2013.01); *G09F 23/06* (2013.01)

(58) Field of Classification Search

CPC ..... G09F 7/10; G09F 7/08

See application file for complete search history.

(56) References Cited

U.S. PATENT DOCUMENTS

| | | | | |
|---|---|---|---|---|
| 5,189,822 A * | 3/1993 | Schmanski | ..... | G09F 7/00 248/551 |
| 5,343,646 A * | 9/1994 | Cobb | ..... | G09F 7/08 40/585 |
| 5,657,566 A | 8/1997 | Key | | |
| 8,333,027 B1 * | 12/2012 | Vosbikian | ..... | G09F 7/10 40/612 |
| 8,650,785 B1 * | 2/2014 | Logan | ..... | G09F 11/06 40/651 |

(Continued)

FOREIGN PATENT DOCUMENTS

| | | |
|---|---|---|
| DE | 43 36 906 A1 | 5/1995 |
| DE | 297 11 920 U1 | 7/1998 |

(Continued)

OTHER PUBLICATIONS

International Search Report and Written Opinion for corresponding Patent Application No. PCT/EP2017/079965 dated Feb. 22, 2018.

*Primary Examiner* — Gary C Hoge

(74) *Attorney, Agent, or Firm* — Renner, Otto, Boisselle & Sklar, LLP

(57) ABSTRACT

A display sign, comprising: a main body (3); a display section (5); and a movable body (7), which is movable in relation to the main body and configured to provide for locking and release of the display section so as to allow for removal and/or replacement of at least part of the display section.

22 Claims, 18 Drawing Sheets

(56) References Cited

U.S. PATENT DOCUMENTS

| | | | | |
|---|---|---|---|---|
| 8,733,000 | B1 | 5/2014 | Thakker | |
| 8,808,006 | B2 | 8/2014 | Ureles et al. | |
| 9,747,818 | B1 * | 8/2017 | Benedict | G09F 7/18 |
| 2001/0045038 | A1 * | 11/2001 | Szalay | G09F 7/10<br>40/661 |
| 2006/0012189 | A1 * | 1/2006 | Olivier | G09F 7/08<br>292/336.3 |
| 2006/0130383 | A1 * | 6/2006 | Bradley | G09F 7/10<br>40/611.06 |
| 2007/0042151 | A1 * | 2/2007 | Dwyer | G09F 7/00<br>428/45 |
| 2007/0283605 | A1 * | 12/2007 | Maier-Hunke | G09F 7/22<br>40/584 |
| 2017/0092161 | A1 * | 3/2017 | Anzalone | G09F 7/18 |
| 2019/0290022 | A1 * | 9/2019 | White | A47F 5/0807 |

FOREIGN PATENT DOCUMENTS

| | | | |
|---|---|---|---|
| DE | 102 14 402 | A1 | 10/2003 |
| FR | 2 284 156 | A | 4/1976 |
| GB | 187079 | A | 10/1922 |

* cited by examiner

DISPLAY SIGN

The present invention relates to a display sign, such as for an office or built environment, and especially in identifying rooms within buildings.

Various display signs for office use exist, and the present inventor has developed an improved sign which allows conveniently for removal and/or replacement of a display insert.

In one aspect the present invention provides a display sign, comprising: a main body; a display section; and a movable body, which is movable in relation to the main body and configured to provide for locking and release of the display section so as to allow for removal and/or replacement of at least part of the display section.

Preferred embodiments of the present invention will now be described hereinbelow by way of example only with reference to the accompanying drawings, in which.

Figure 1:
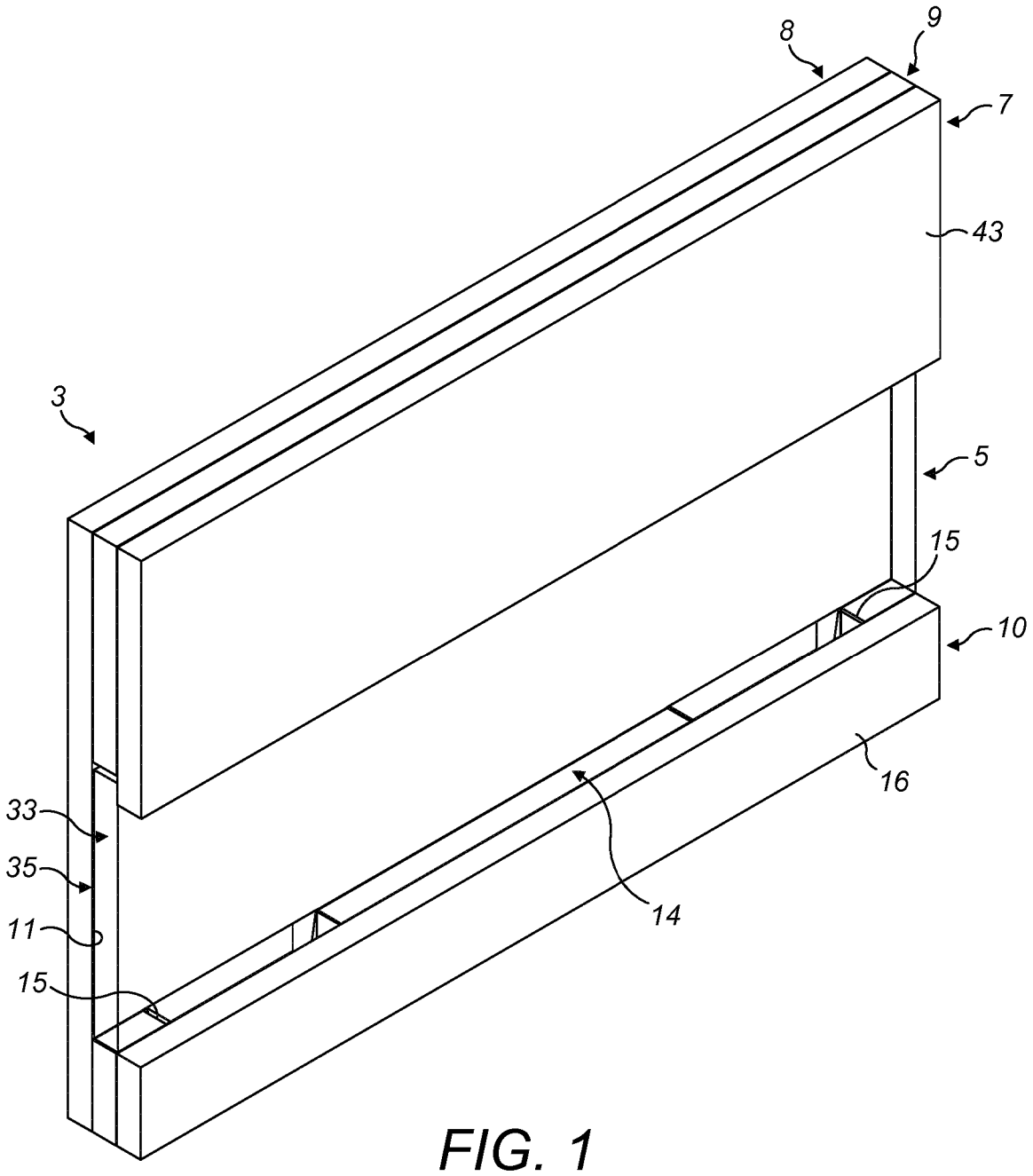
FIG. 1 illustrates a front perspective view of a display sign in accordance with one embodiment of the present invention.
Figure 2:
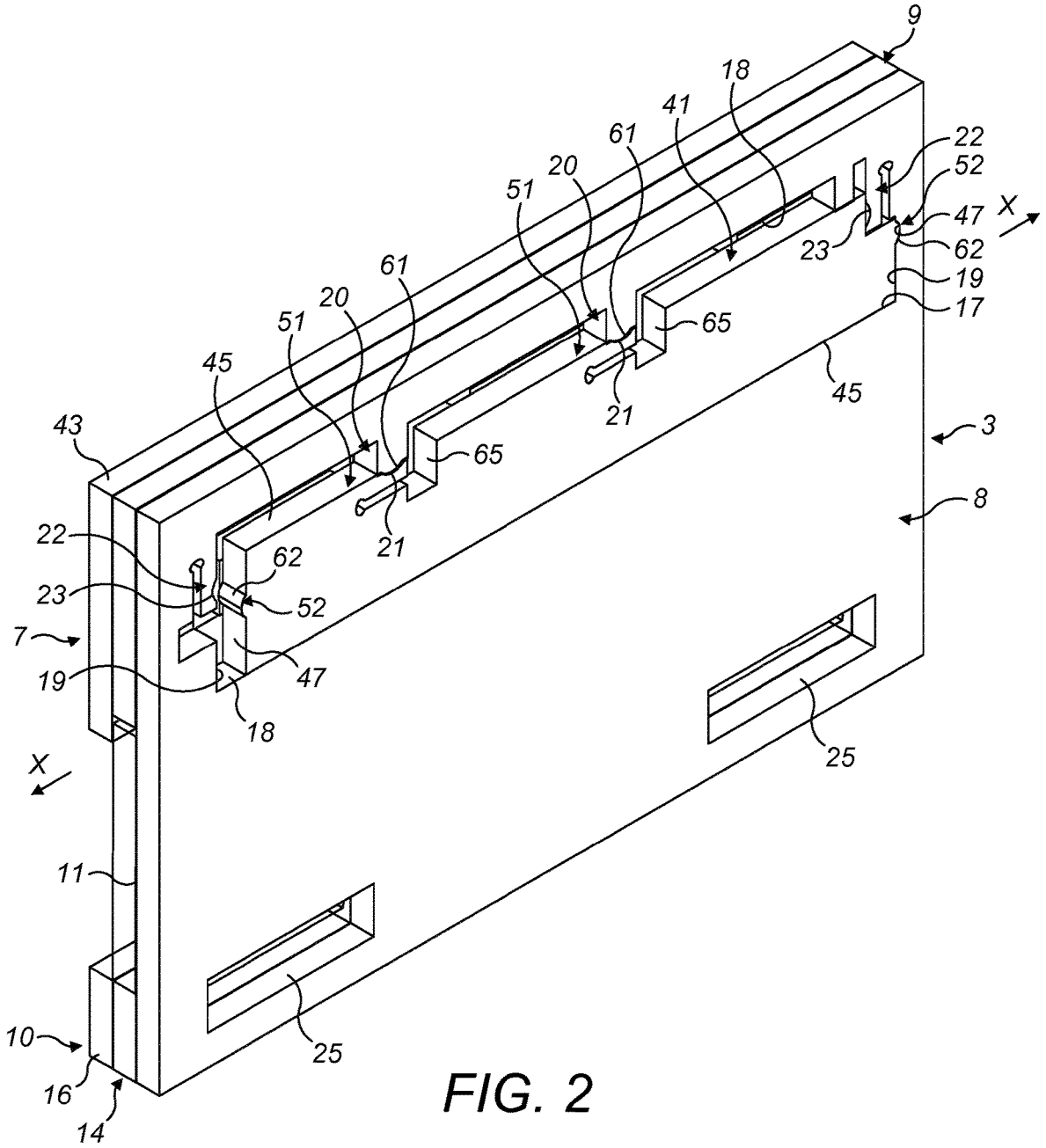
FIG. 2 illustrates a rear perspective view of the display sign of FIG. 1.
Figure 3:
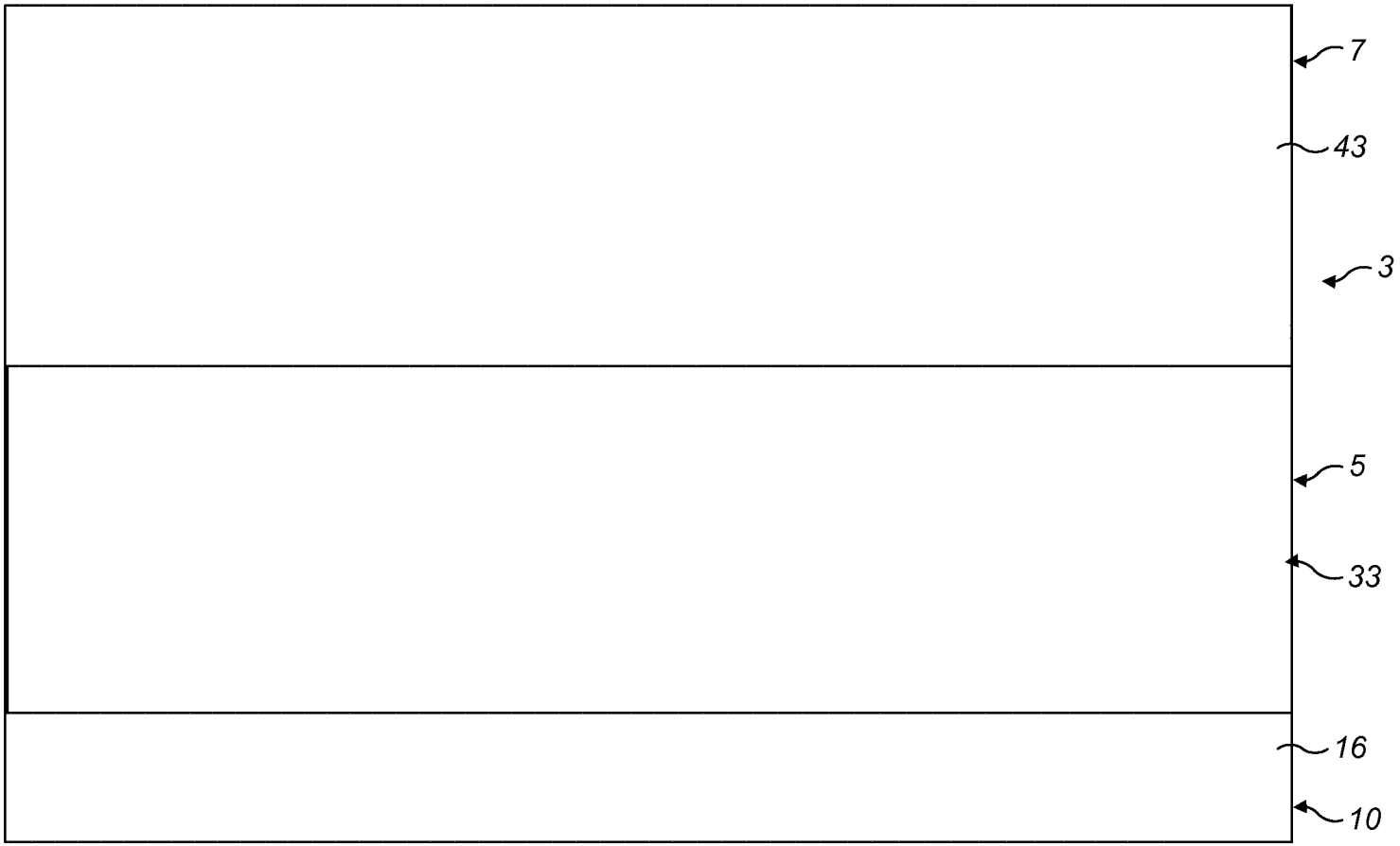
FIG. 3 illustrates a front view of the display sign of FIG. 1.
Figure 4:
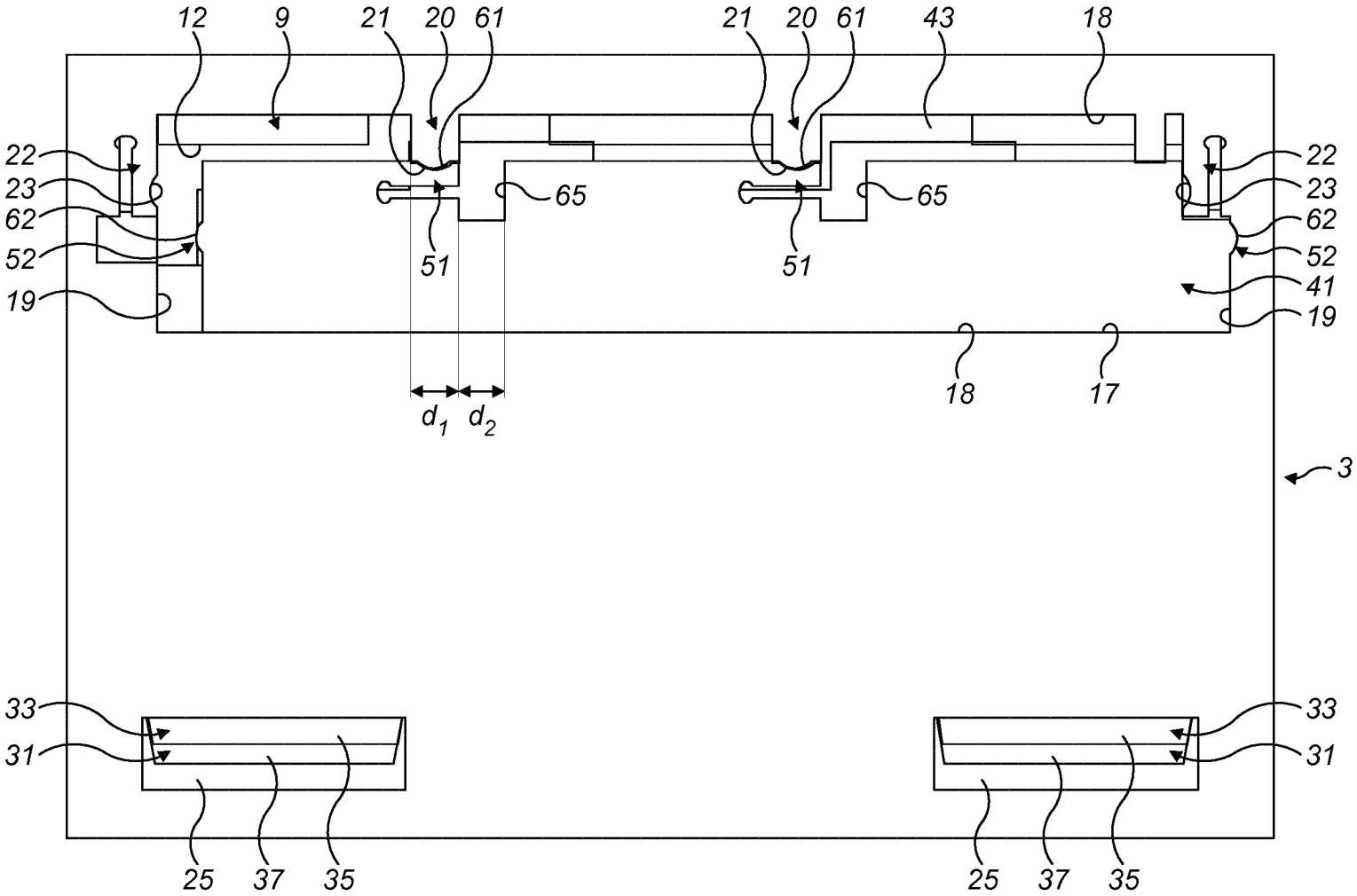
FIG. 4 illustrates a rear view of the display sign of FIG. 1.
Figure 5:
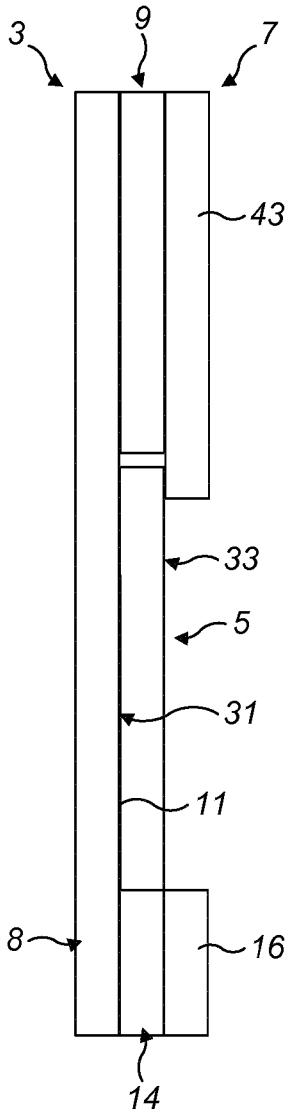
FIG. 5 illustrates a side view of the display sign of FIG. 1.
Figure 7A:
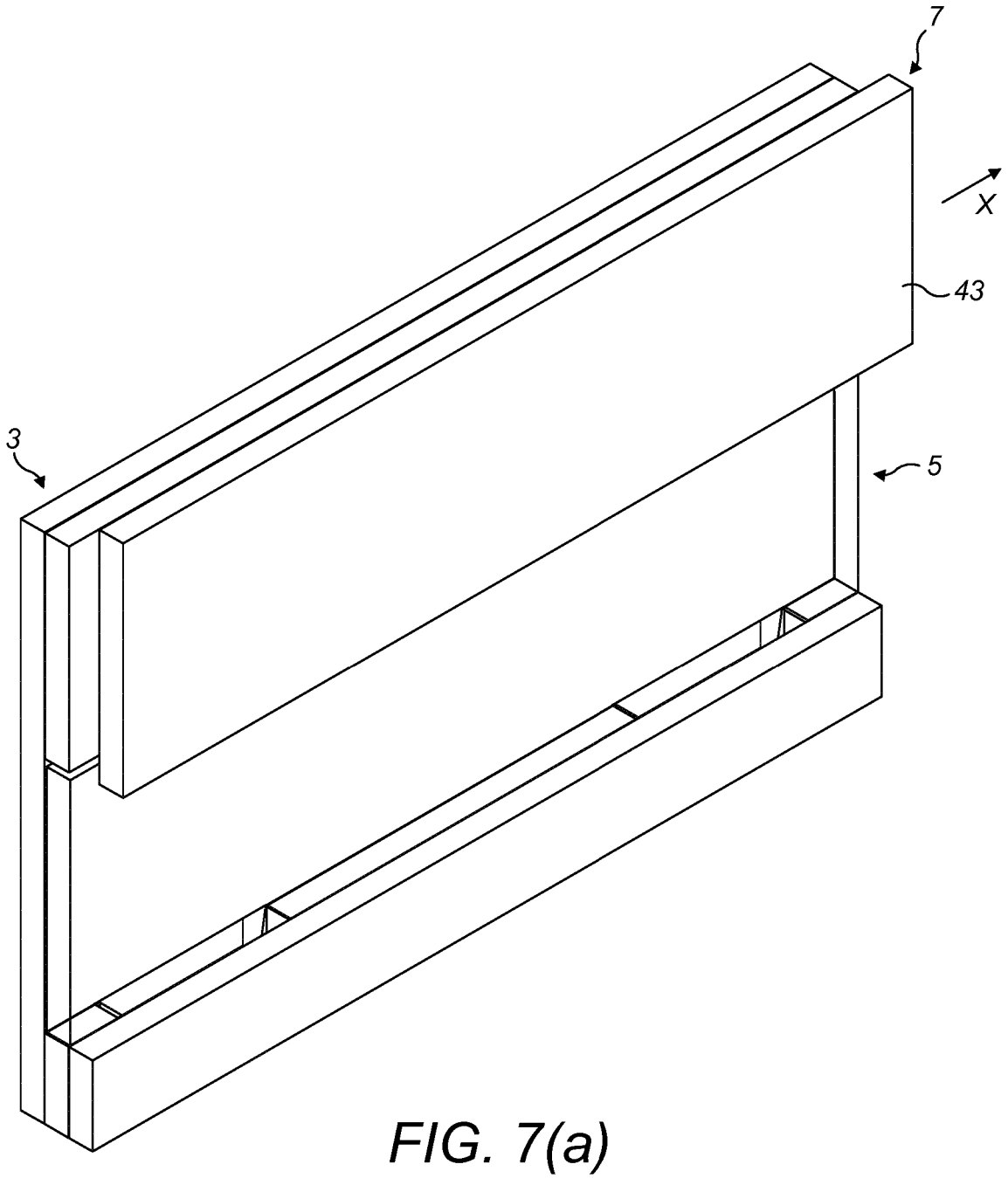
Figure 7B:
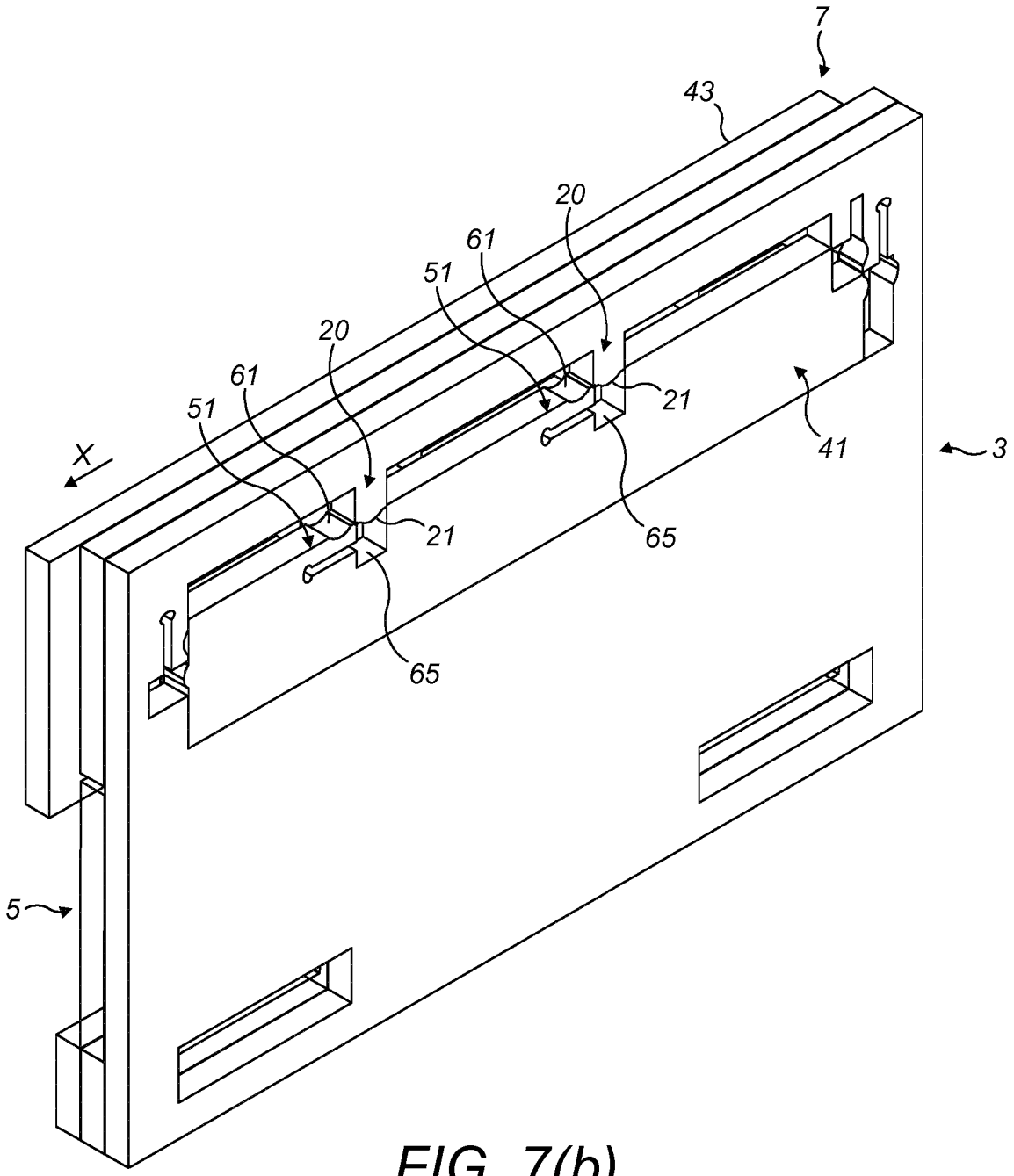
Figure 8A:
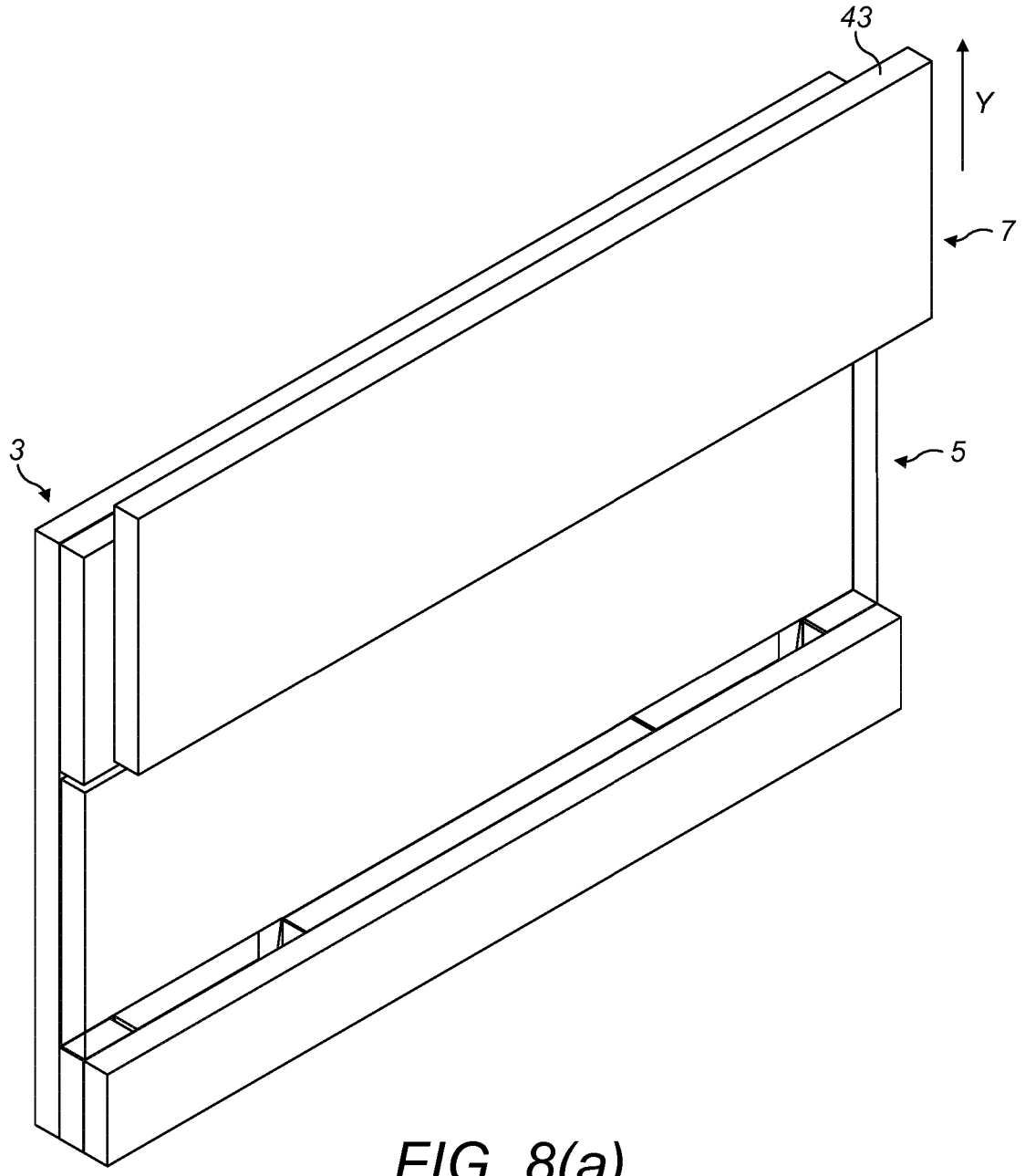
Figure 8B:
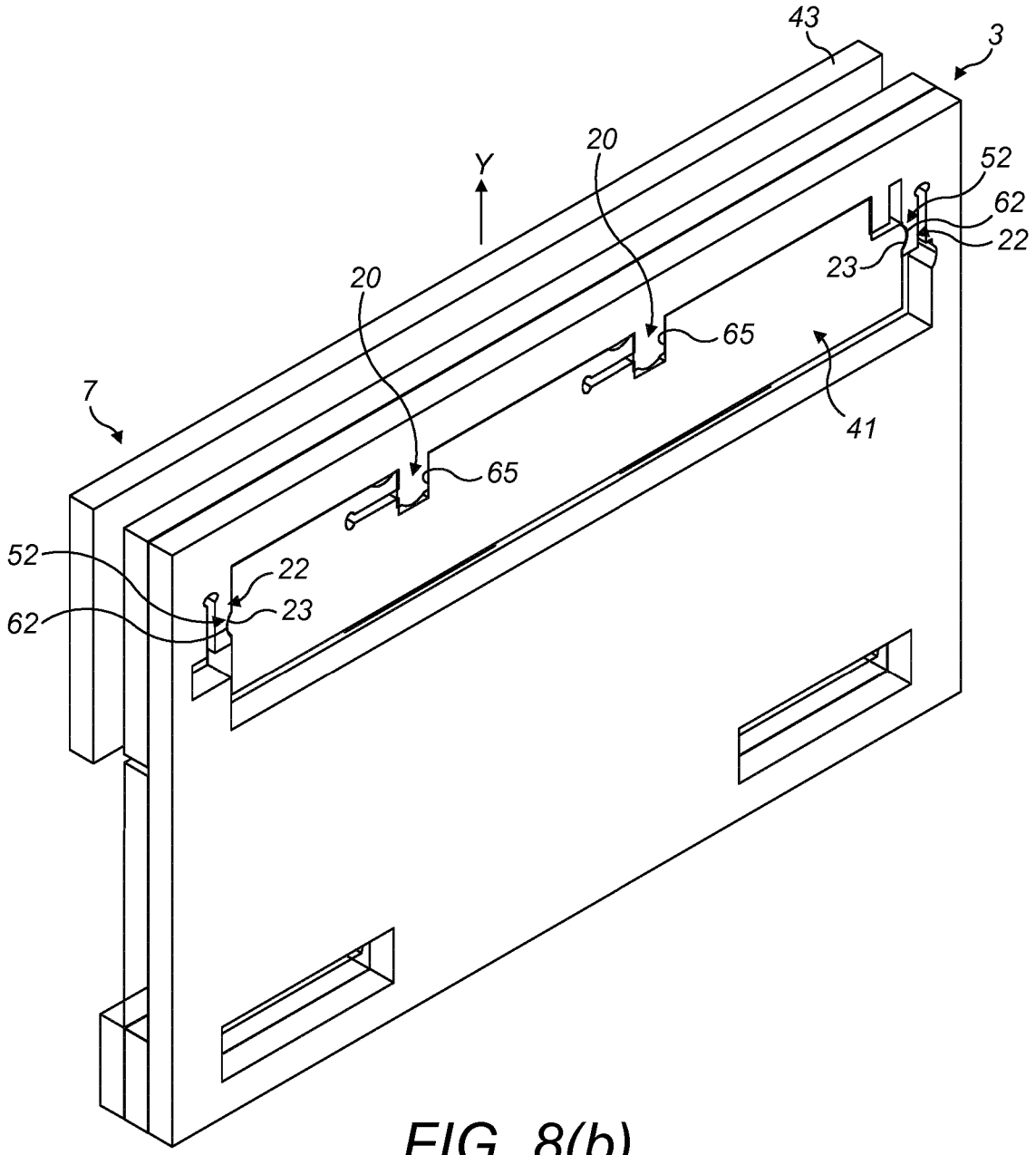
Figure 9A:
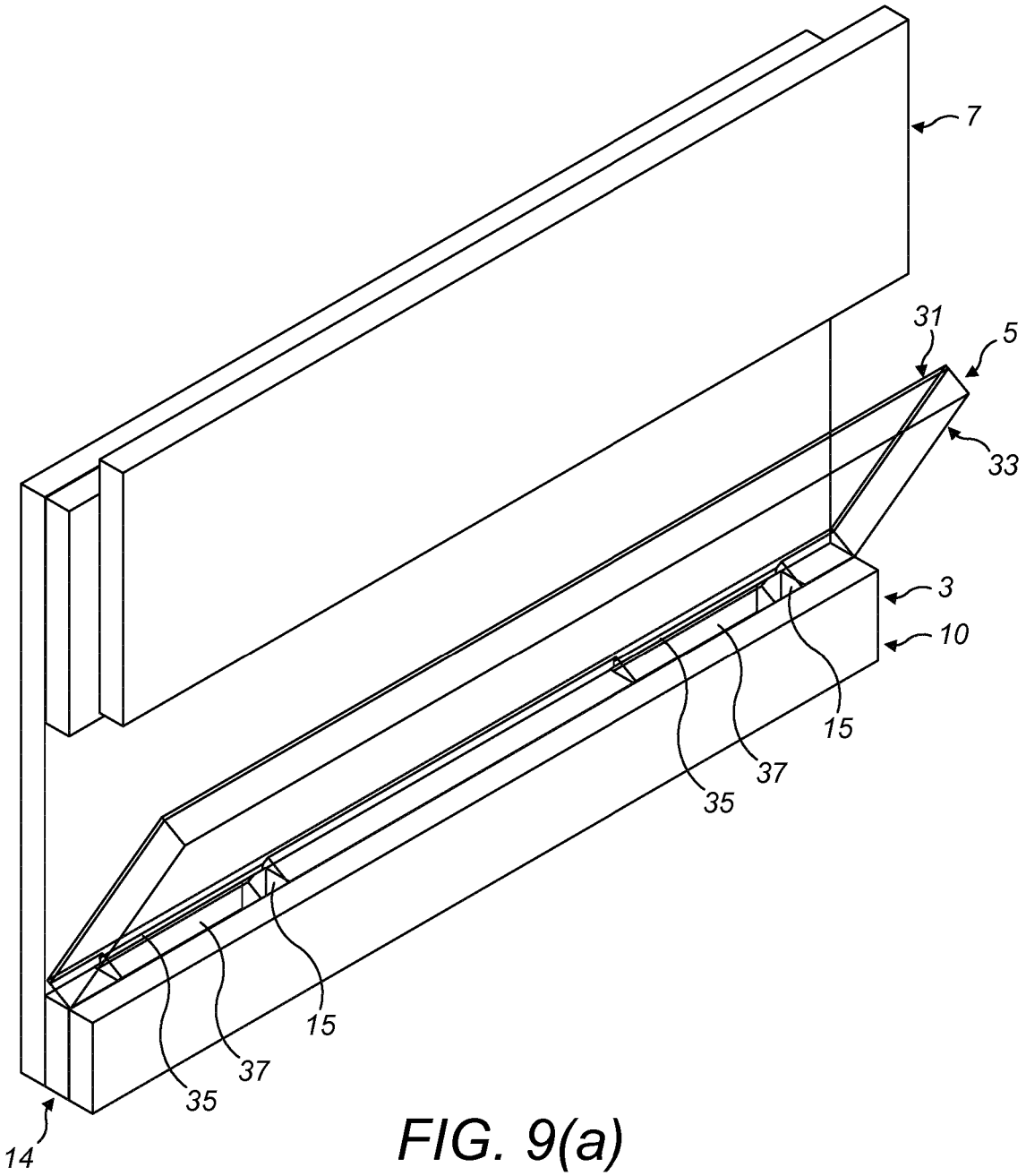
Figure 9B:
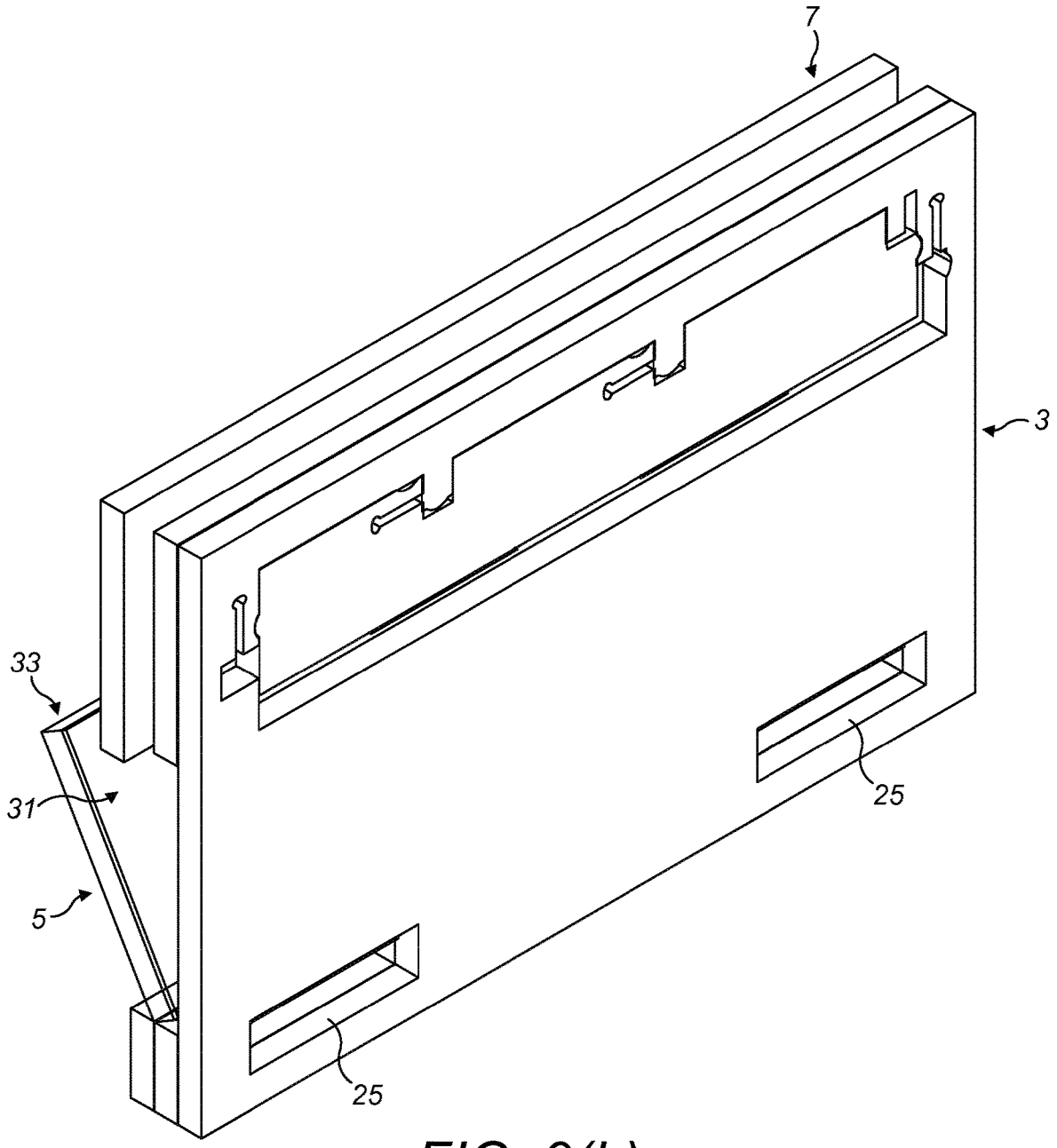
Figure 10A:
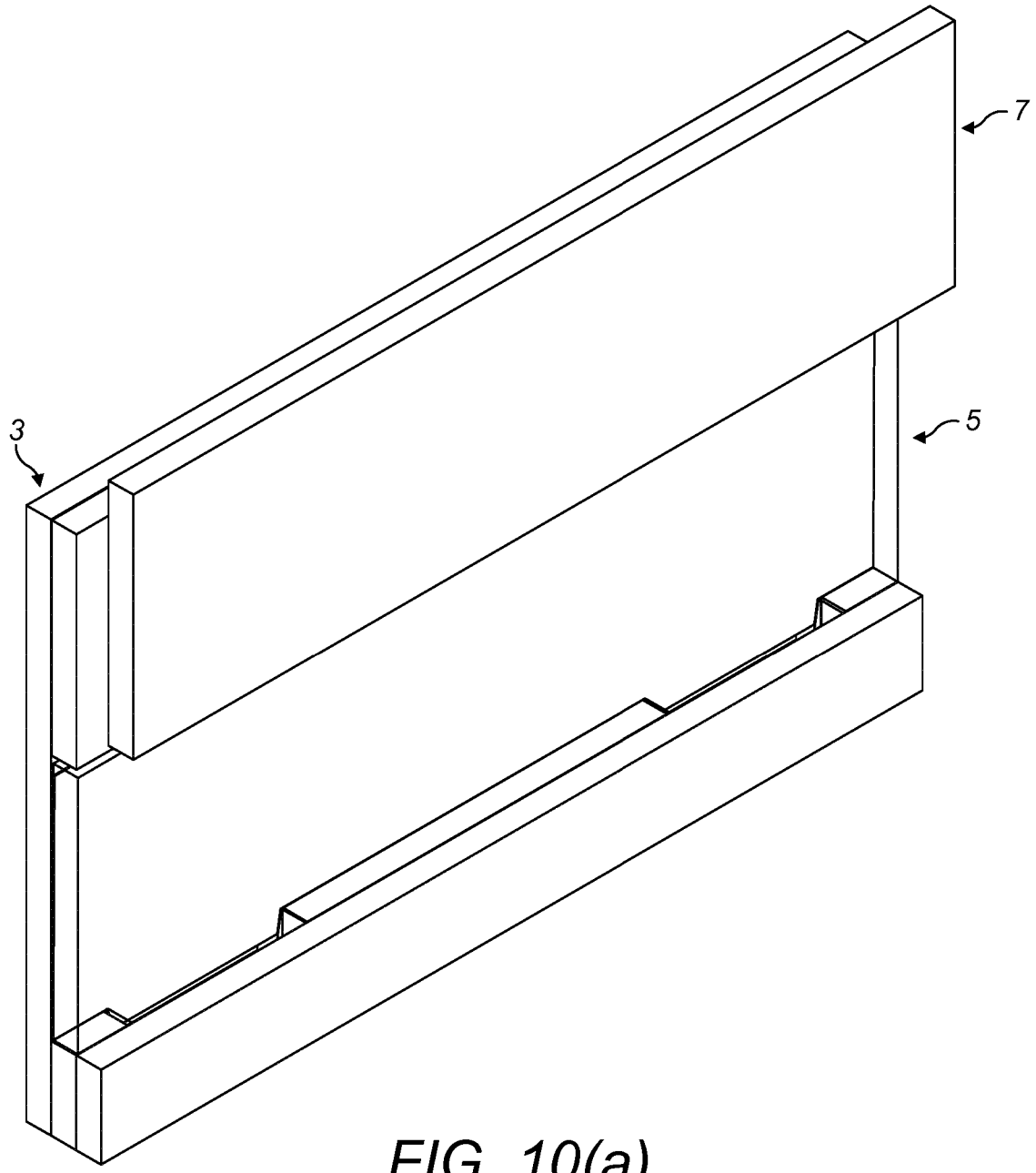
Figure 10B:
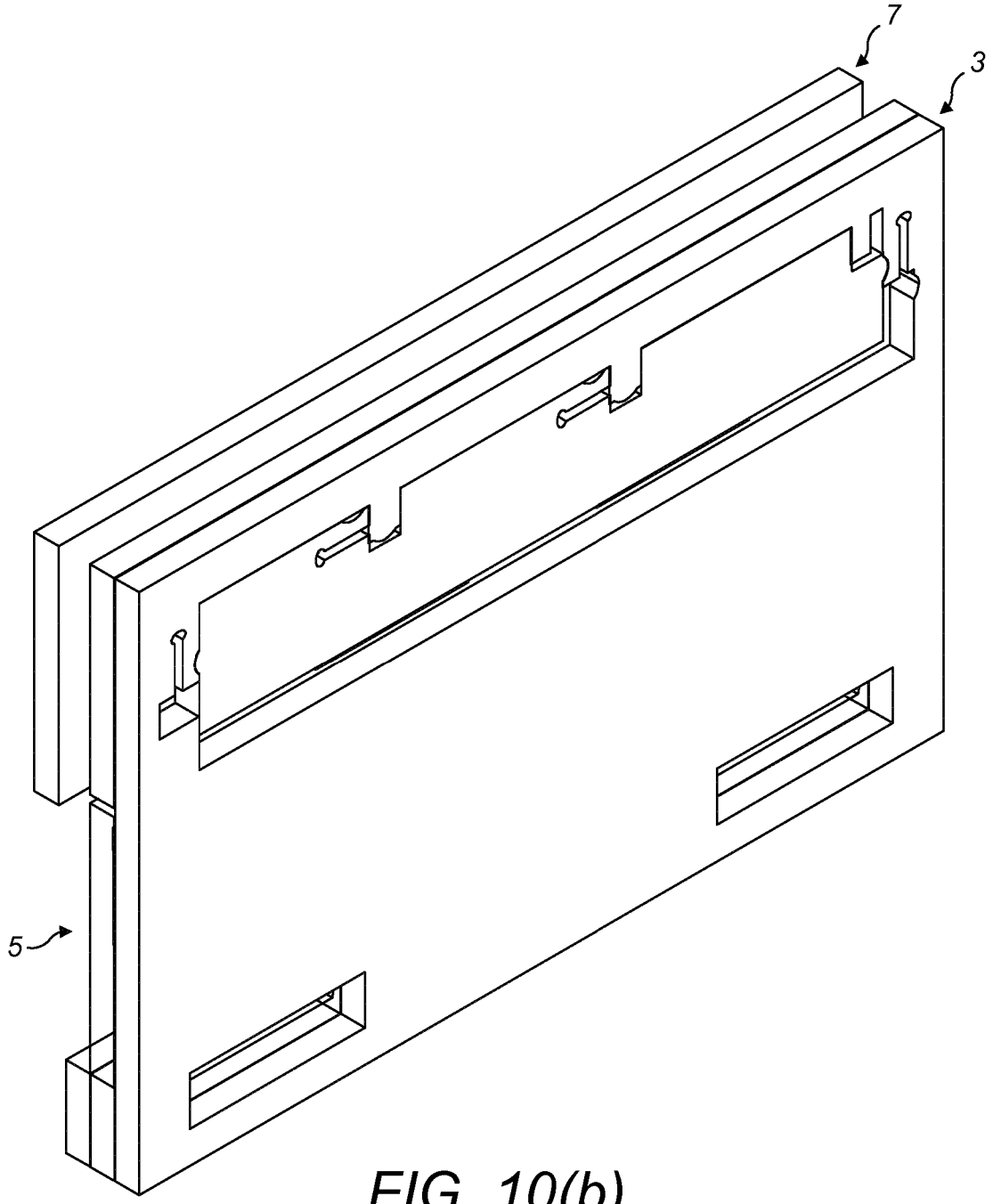
Figure 11A:
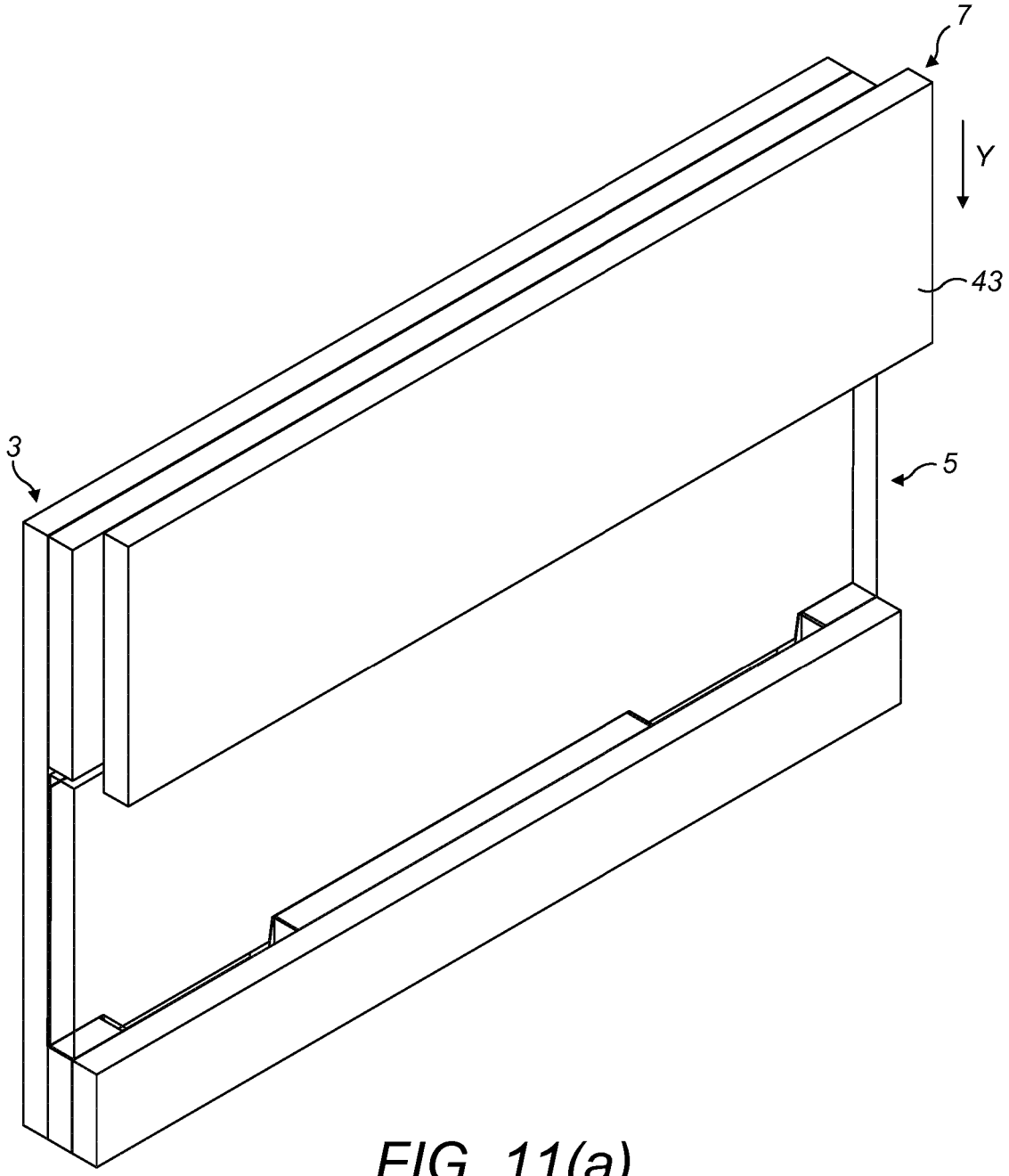
Figure 11B:
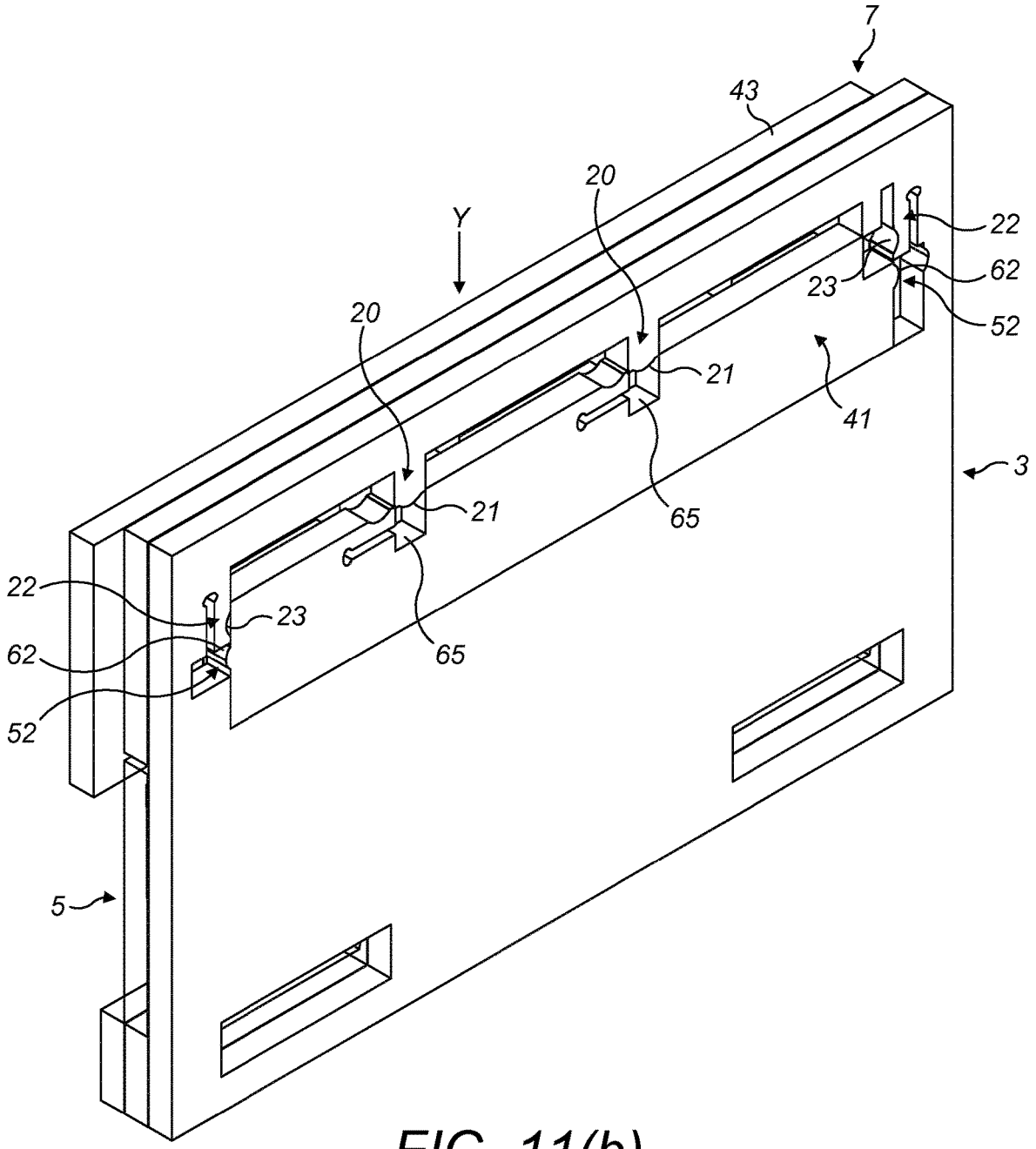
Figure 12A:
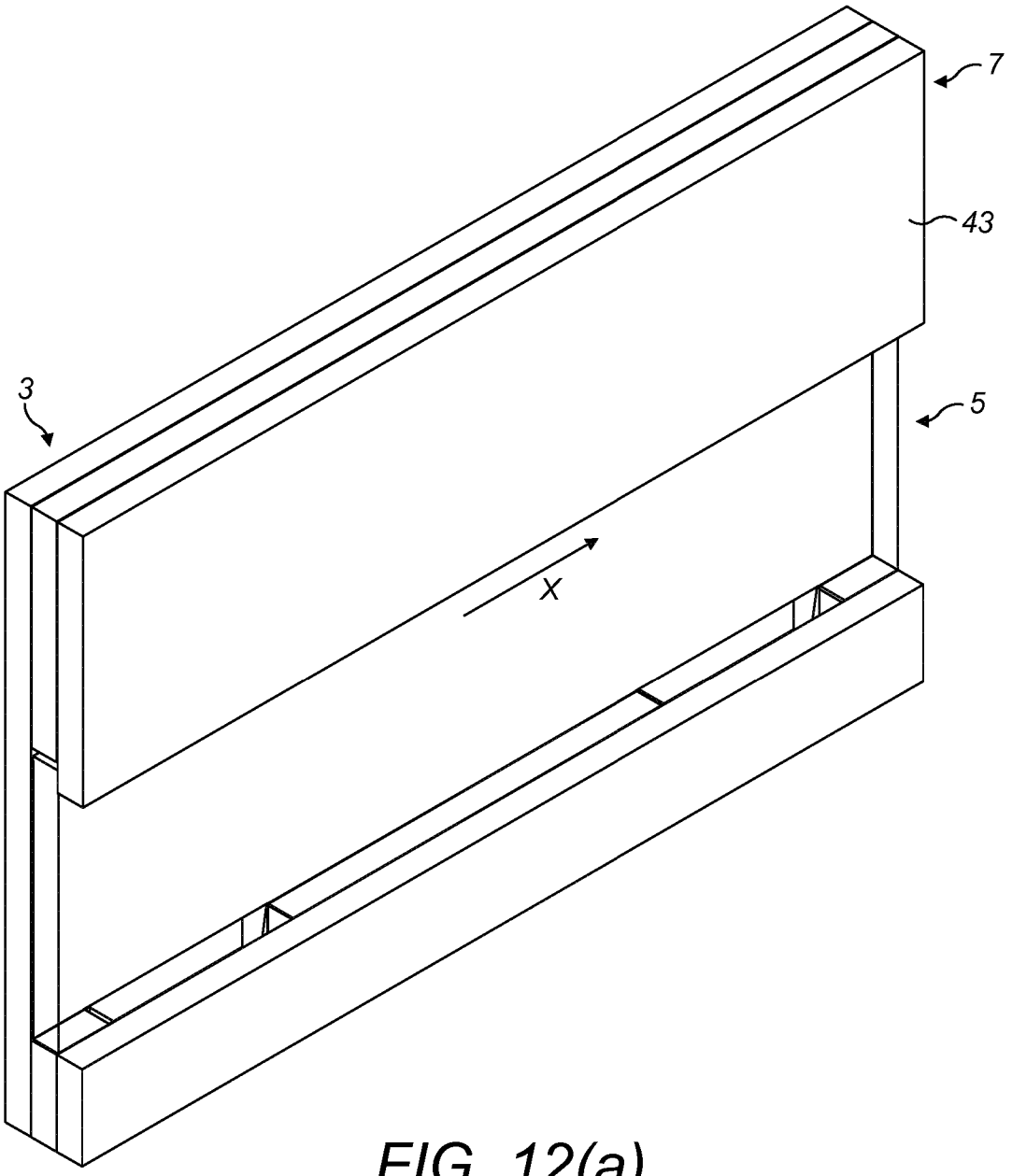
Figure 12B:
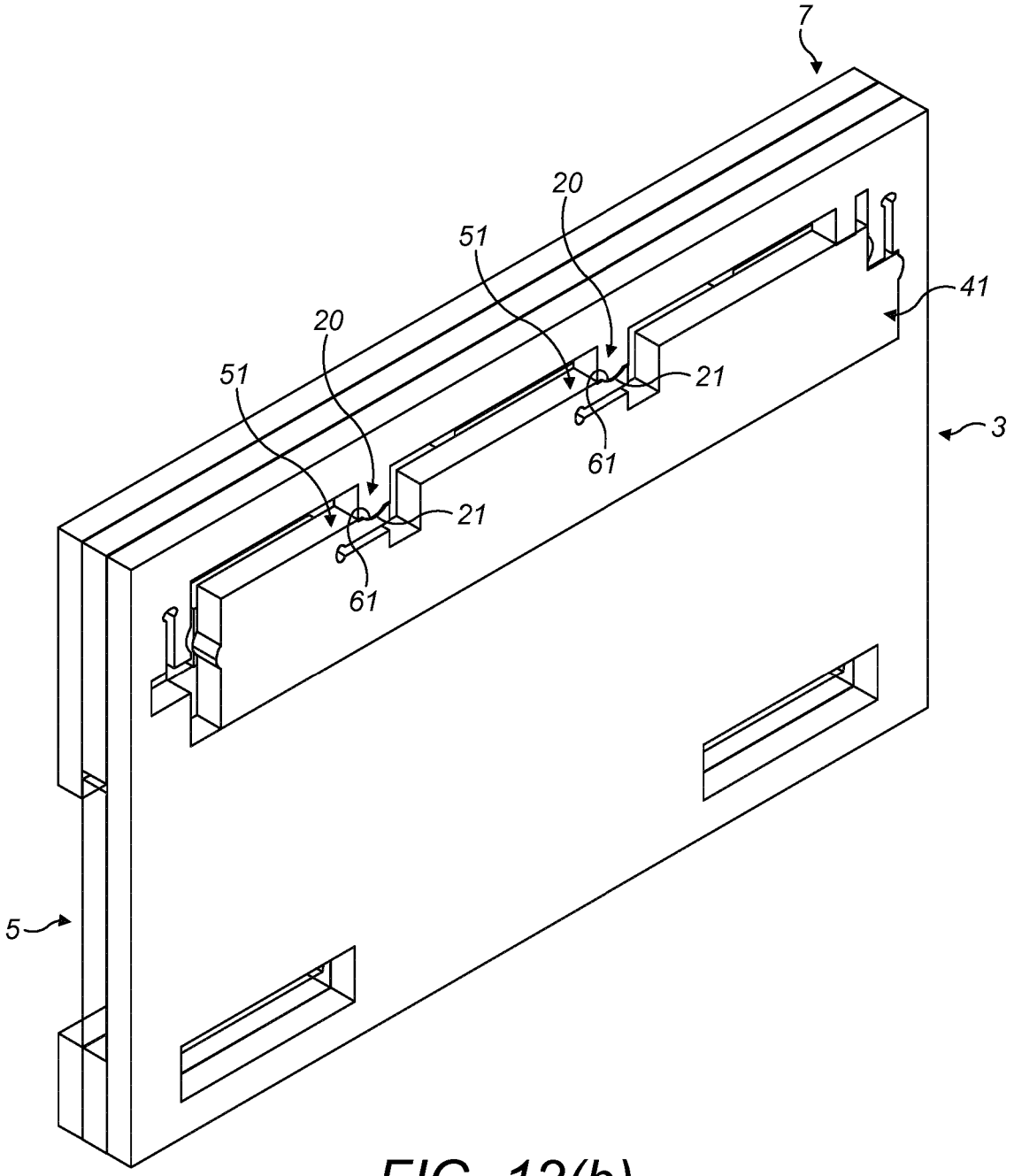

FIGS. 7(*a*) and (*b*) illustrate front and rear perspective views of the display sign of FIG. 1 in which the movable body is moved from a closed position to an intermediate position;

FIGS. 8(*a*) and (*b*) illustrate front and rear perspective views of the display sign of FIG. 1 in which the movable body is in a latched, open position and the display section is in a closed position;

FIGS. 9(*a*) and (*b*) illustrate front and rear perspective views of the display sign of FIG. 1 in which the movable body is in the latched, open position and the display section is opened to allow for removal and/or replacement of at least part thereof;

FIGS. 10(*a*) and (*b*) illustrate front and rear perspective views of the display sign of FIG. 1 in which the movable body is in the latched, open position and the display section is returned to the closed position;

FIGS. 11(*a*) and (*b*) illustrate front and rear perspective views of the display sign of FIG. 1 in which the movable body is returned to the intermediate position; and FIGS. 12(*a*) and (*b*) illustrate front and rear perspective views of the display sign of FIG. 1 in which the movable body is returned to the closed position.

The display sign comprises a main body 3, a display section 5 and a movable body 7, which is movable in relation to the main body 3 and configured to provide for locking and release of the display section 5 so as to allow for removal and/or replacement of at least part of the display section 5.

In this embodiment the main body 3 is formed of sheets or panels, here of plastics material, which are bonded, such as by adhesive.

In this embodiment the main body 3 comprises a rear section 8, which is mounted to a wall or other building structure, a spacer 9 which is disposed to one, front face of the rear section 8 and spaces a face panel 43 of the movable body 7 from the rear section 8, and an engagement section 10 to which the display section 5 is engaged.

In this embodiment the spacer 9 and the engagement section 10 define a recess 11 therebetween, in which the display section 5 is disposed.

Figure 6:
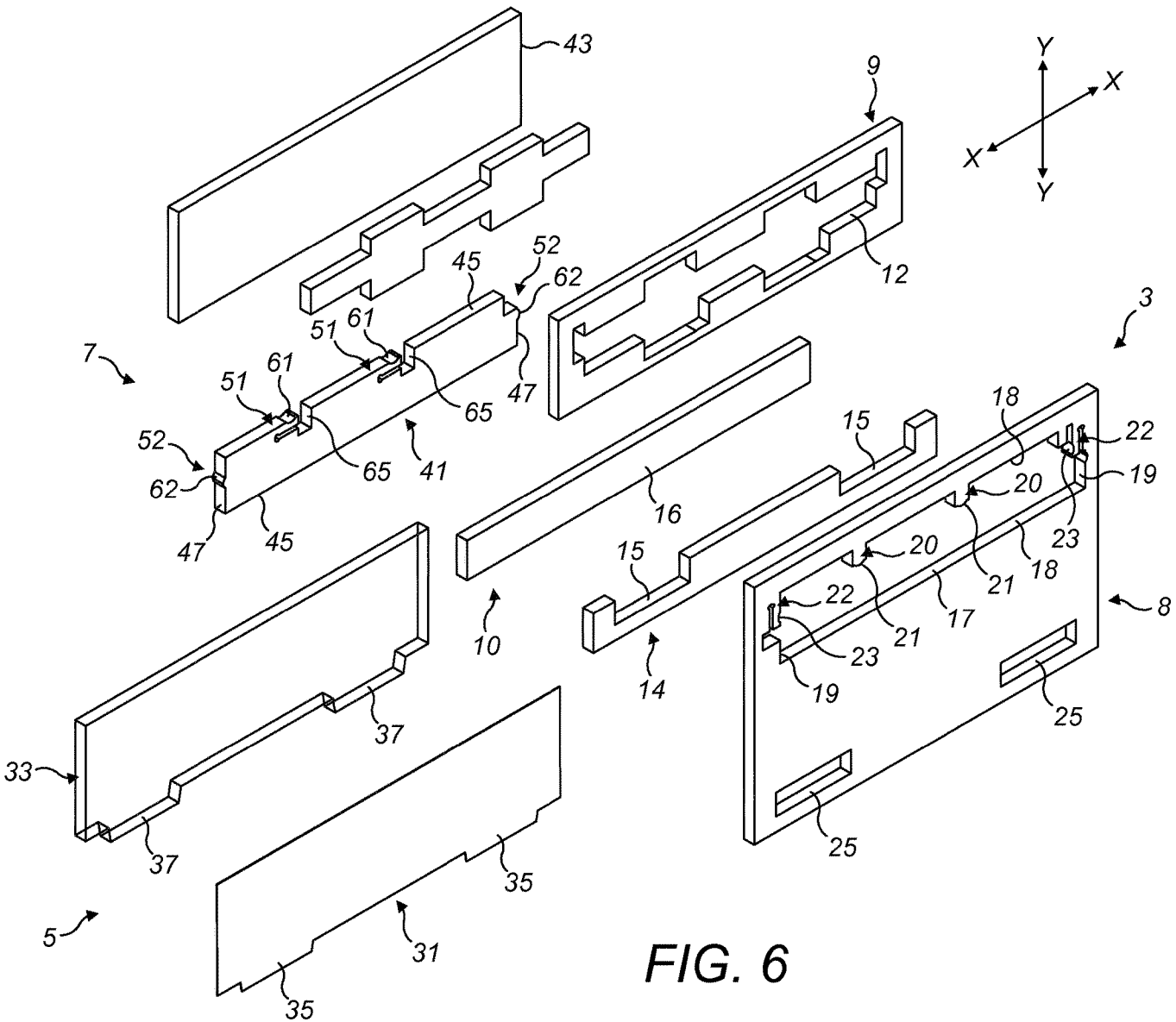
FIG. 6 illustrates an exploded perspective view of the display sign of FIG. 1.

In this embodiment the spacer 9, as particularly illustrated in FIG. 6, includes an aperture 12 which is shaped captively to retain a slider 41 of the movable body 7, but allow movement of the movable body 7 in first and second orthogonal directions X, Y.

In this embodiment the engagement section 10 comprises an engagement element 14, which is attached to the front face of the rear section 8 and includes at least one recess, here a plurality of recesses 15, for receiving the display section 5, and a face panel 16, which is attached to the engagement element 14.

In this embodiment the engagement section 10 provides a lower, footer to the display sign.

In this embodiment the main body 3 includes a cavity 17, in which the slider 41 of the movable body 7 is slideable.

In this embodiment the cavity 17 is substantially rectangular in profile and has opposed longitudinal sides 18 and opposed ends 19.

In this embodiment the main body 3 includes at least one, here a plurality of first engagement elements 20, which are arranged in spaced relation.

In this embodiment the first engagement elements 20 are disposed to one, here the upper, of the longitudinal sides 18 of the cavity 17 and the other, here the lower, of the longitudinal sides 18 of the cavity 17 defines a sliding surface on which the slider 41 of the movable body 7 is slideable in the first direction X.

In this embodiment the first engagement elements 20 each include a detent 21, here at the distal end thereof.

In this embodiment the first engagement elements 20 comprise projections which have a width $d_1$ and extend in the second direction Y.

In this embodiment the main body 3 includes at least one, here a plurality of second engagement elements 22, which act to hold the slider 41 of the movable body 7 in a latched, open position, as will be described in more detail hereinbelow.

In this embodiment the second engagement elements 22 are disposed to respective ends 19 of the cavity 17.

In this embodiment the second engagement elements 22 are resilient elements, which engage corresponding engagement elements 52 on the slider 41 of the movable body 7.

In this embodiment the second engagement elements 22 each include a detent 23, here in the form of a recess.

In this embodiment the main body 3 includes at least one, here a plurality of openings 25, which receive hinge elements 35, 37 of the display section 5, as will be described in more detail hereinbelow.

In this embodiment the display section 5 comprises a display insert 31 which bears information, and a display panel 33 which covers the display insert 31 to enclose the same.

In this embodiment the display insert 31 includes at least one, here a plurality of tab elements 35, here at a lower edge thereof, which locate in the recesses 15 in the engagement section 10, and, with the movable body 7 in the unlocked position, the display section 5 allows for hinging of the display panel 33 and removal and/or replacement of the display insert 31.

In this embodiment the display insert 31 is formed of paper, but could be formed of other materials, such as card or plastics sheet.

In this embodiment the display panel 33 is at least partially transparent so as to allow information on the display insert 31 to be viewed.

In this embodiment the display panel 33 includes at least one, here a plurality of tab elements 37, here at a lower edge thereof, which locate in the recesses 15 in the engagement section 10.

In an alternative embodiment the display section 5 could comprise only the display panel 33 which bears information.

In this embodiment the movable body 7 comprises a slider 41 which is captively disposed within the cavity 17 in the main body 3 and a face panel 43 which is attached to slider 41, such that the slider 41 is moved by movement of the face panel 43.

In this embodiment the slider 41 is substantially rectangular in profile and has longitudinal sides 45 and ends 47.

In this embodiment the slider 41 includes at least one, here a plurality of first engagement elements 51, which are arranged in spaced and counterpart relation to the first engagement elements 20 of the main body 3, and at least one, here a plurality of second engagement elements 52, which are arranged in spaced and counterpart relation to the second engagement elements 22 of the main body 3.

In this embodiment the first engagement elements 51 of the slider 41 are disposed to one of the longitudinal sides 45 of the slider 41 and the other of the longitudinal sides 47 of the slider 41 defines a sliding surface which engages the sliding surface of the other, lower longitudinal side 18 of the cavity 17 in the main body 3.

In this embodiment the first engagement elements 51 of the slider 41 each include a detent 61, here in the form of a recess, which engages the respective detent 21 on the counterpart first engagement element 20 of the main body 3.

In this embodiment the first engagement elements 51 of the slider 41 are resilient elements, which allow the detents 21, 61 to be engaged and disengaged with movement of the movable body 7 in the first direction X.

In this embodiment the second engagement elements 52 of the slider 41 each include a detent 62.

In this embodiment the slider 41 includes at least one, here a plurality of recesses 65, which are disposed adjacent the at least one, here plurality of first engagement elements 51 of the slider 41.

In this embodiment the recesses 65 each have a width $d_2$ which is greater than the width $d_1$ of the first engagement elements 20 of the main body 3, such that, when the slider 41 is moved in the first direction X, the recesses 65 in the slider 41 can be aligned with the first engagement elements 20 of the main body 3, which allows the movable body 7 to be moved in a second direction Y, orthogonal to the first direction X, with the first engagement elements 20 of the main body 3 being received in the recesses 65 in the slider 41, as will be described in more detail hereinbelow.

In this embodiment the face panel 43 of the movable body 7 provides an upper, header of the display sign.

Operation of the display sign will now be described with reference to FIGS. 7 to 12 of the accompanying drawings.

In a first step, as illustrated in FIGS. 7(*a*) and (*b*), the face panel 43 of the movable body 7 is slid in the first direction X, here laterally to the right, which causes the slider 41 to be moved in the first direction X from a locked position, releasing the detents 61 of the first engagement elements 51 of the slider 41 from the detents 21 of the first engagement elements 20 of the main body 3, to an intermediate position, in which the first engagement elements 20 of the main body 3 are aligned with the recesses 65 in the slider 41. In this intermediate position, the display section 5 remains locked in a locked position by engagement of the display panel 33 of the display section 5 behind the face panel 43 of the movable body 7.

Subsequently, as illustrated in FIGS. 8(*a*) and (*b*), the face panel 43 of the movable body 7 is slid in the second direction Y, here upwardly, which causes the slider 41 to be moved in the second direction Y from the intermediate position to an open position, in which the movable body 7 is latched open and the display panel 33 of the display section 5 is disengaged from the face panel 43 of the movable body 7, allowing the display section 5 to be opened for removal and replacement.

In moving the face panel 43 of the movable body 7 in the second direction Y, the first engagement elements 20 of the main body 3 are received in the recesses 65 in the slider 41 of the movable body 7, and the detents 62 of the second engagement elements 52 of the slider 41 engage the detents 23 of the second engagement elements 22 of the main body 3 and latch the slider 41, and hence the movable body 7, in the open position.

With the movable body 7 in the open position, the display section 5 can be opened to allow for removal and/or replacement of at least part thereof, as illustrated in FIGS. 9(*a*) and (*b*). In this embodiment the display sheet 31, which bears information, is removed and/or replaced.

Following removal and/or replacement of the display section 5, the display section 5 is closed, as illustrated in FIGS. 10(*a*) and (*b*)

Then, as illustrated in FIGS. 11(*a*) and (*b*), the face panel 43 of the movable body 7 is slid in the second direction Y, here downwardly, which causes the slider 41 to be moved in the second direction Y from the open position to the intermediate position, in which the detents 62 of the second engagement elements 52 of the slider 41 are disengaged from the detents 23 of the second engagement elements 22 of the main body 3 and the first engagement elements 20 of the main body 3 are withdrawn from the recesses 65 in the slider 41 of the movable body 7.

Finally, as illustrated in FIGS. 12(*a*) and (*b*), the face panel 43 of the movable body 7 is slid in the first direction X, here laterally to the left, which causes the slider 41 to be moved in the first direction X from the intermediate position to the locked position, in which the detents 61 of the first engagement elements 51 of the slider 41 are engaged with the detents 21 of the first engagement elements 20 of the main body 3.

Finally, it will be understood that the present invention has been described in its preferred embodiments and can be modified in many different ways without departing from the scope of the invention as defined by the appended claims.

The invention claimed is:

1. A display sign, comprising:

a main body;

a display section; and a movable body, which is movable in relation to the main body and configured to provide for locking and release of the display section so as to allow for removal and/or replacement of at least part of the display section; and wherein the main body includes a cavity and the movable body comprises a slider which is slideably disposed in the cavity of the main body in a first direction between a closed position and an intermediate position and a second direction between the intermediate position and an open position.

2. The sign of claim 1, wherein the main body is formed of sheets or panels.

3. The sign of claim 1, wherein the main body comprises a rear section, which is mountable to a wall or other building structure, and an engagement section to which the display section is engaged, wherein the engagement section comprises an engagement element, which includes at least one recess for receiving at least one feature of the display section, and a face panel.

4. The sign of claim 3, wherein the engagement element is attached to a front face of the rear section and the face panel is attached to the engagement element.

5. The sign of claim 1, wherein the cavity is elongate in profile.

6. The sign of claim 1, wherein the main body and the slider of the movable body each include at least one first engagement element, and the first engagement elements are engaged when the movable body is in the closed position to lock the movable body in position.

7. The sign of claim 6, wherein the first engagement elements each include a detent, and the detents are captively engaged when the movable body is in the closed position.

8. The sign of claim 6, wherein the at least one first engagement element of the main body is disposed to one longitudinal side of the cavity and the other longitudinal side of the cavity defines a sliding surface on which the slider of the movable body is slideable.

9. The sign of claim 6, wherein the at least one first engagement element of at least one of the main body and the slider of the movable body is a resiliently-biased element.

10. The sign of claim 6, wherein the main body and the slider of the movable body each include a plurality of first engagement elements which are arranged in spaced relation.

11. The sign of claim 6, wherein the main body and the slider of the movable body each include at least one second engagement element, and the second engagement elements are engaged when the movable body is in the open position to latch the movable body in the open position.

12. The sign of claim 11, wherein the second engagement elements are disposed to adjacent ends of the cavity of the main body and the slider of the movable body.

13. The sign of claim 11, wherein the at least one second engagement element of at least one of the main body and the slider of the movable body is a resiliently-biased element.

14. The sign of claim 11, wherein the second engagement elements each include a detent, and the detents are captively engaged when the moveable body is in the open position.

15. The sign of claim 1, wherein the at least one engagement element of one of the main body and the slider of the movable body comprises a projection which extends in the second direction, and the other of the main body of the slider of the movable body includes at least one recess which receives the projection of the one of the main body and the slider of the movable body only when the slider of the movable body is moved in the second direction from the intermediate position, thereby preventing movement of the slider of the movable body in the second direction when the slider of the movable body is in other than the intermediate position.

16. The sign of claim 15, wherein the at least one recess in the other of the main body of the slider of the movable body is disposed adjacent the at least one first engagement element in the one of the main body of the slider of the movable body.

17. The sign of claim 15, wherein the other of the main body of the slider of the movable body includes a plurality of recesses which are arranged in spaced, counterpart relation to the first engagement elements on the one of the main body and the slider of the movable body.

18. The sign of claim 1, wherein the movable body further comprises a face panel which is attached to the slider thereof, such that the slider is moved by movement of the face panel.

19. The sign of claim 18, wherein the main body comprises a rear section and a spacer which is disposed to one, front face of the rear section and spaces the face panel of the movable body from the rear section.

20. The sign of claim 19, wherein the spacer and the engagement section define a recess therebetween, in which the display section is disposed, and the spacer includes an aperture which is shaped so that the slider of the moveable body is held captive in the cavity of the main body, but allows for movement of the moveable body in first and second directions.

21. The sign of claim 1, wherein the display section comprises a display insert which bears information, and a display panel which is at least partially transparent and covers the display insert to enclose the same, the cover panel being movable to an open position when the movable body is in the open position so as to allow for removal and/or replacement of the display insert.

22. The sign of claim 1, wherein the display section comprises a display panel which bears information and is movable to an open position when the movable body is in the open position so as to allow for removal and/or replacement of the display panel.

* * * * *